US005598787A

United States Patent [19]

Pronk

[11] Patent Number: 5,598,787

[45] Date of Patent: Feb. 4, 1997

[54] PALLET/SPACER ASSEMBLY

[76] Inventor: Mattheus A. J. Pronk, Vishouwer 8, NL-1749 HH, Warmenhuizen, Netherlands

[21] Appl. No.: 501,092

[22] PCT Filed: Feb. 11, 1994

[86] PCT No.: PCT/NL94/00034

§ 371 Date: Aug. 14, 1995

§ 102(e) Date: Aug. 14, 1995

[87] PCT Pub. No.: WO94/18082

PCT Pub. Date: Aug. 18, 1994

[30] Foreign Application Priority Data

Feb. 12, 1993 [NL] Netherlands ..... 9300280

[51] Int. Cl.[6] ..... B65D 19/38

[52] U.S. Cl. ..... 108/53.1; 108/51.1; 108/51.3

[58] Field of Search ..... 108/53.1, 53.3, 108/53.5, 51.3, 51.1, 91, 92

[56] References Cited

U.S. PATENT DOCUMENTS

| | | | |
|---|---|---|---|
| 2,495,711 | 1/1950 | Fletcher | 108/53.5 |
| 2,895,186 | 7/1959 | Franks . | |
| 3,364,883 | 1/1968 | Evans | 108/53.5 |
| 3,500,770 | 3/1970 | Skubic | 108/53.5 |
| 4,102,525 | 7/1978 | Albano | 108/51.3 X |
| 5,224,678 | 7/1993 | McClellan | 108/53.1 |
| 5,345,879 | 9/1994 | Maillard | 108/53.1 |

FOREIGN PATENT DOCUMENTS

| | | | |
|---|---|---|---|
| 7092587 | 10/1987 | Australia . | |
| 770989 | 11/1967 | Canada | 108/53.3 |
| 108908 | 2/1968 | Denmark | 108/53.3 |
| 2342044 | 9/1977 | France | 108/91 |
| 2559127 | 8/1985 | France . | |
| 2159650 | 6/1972 | Germany | 108/55.5 |
| 436126 | 11/1967 | Switzerland | 108/53.5 |
| 708924 | 5/1954 | United Kingdom . | |
| 1163135 | 9/1969 | United Kingdom . | |

*Primary Examiner*—Jose V. Chen
*Attorney, Agent, or Firm*—Young & Thompson

[57] ABSTRACT

Pallets/spacer assembly, comprising a substantially rectangular pallet (2) and four spacers (1), one spacer being fitted at each corner of the pallet. Each spacer has a first wall (3) and a second wall (4) secured together at right angles. Each spacer has a first part (11) and a second part (12), only the second part having a third wall (5) secured to a free edge of one of the first and second walls at a right angle. The length (a) of the first part (11) is at least half the height of the pallet, and the length (b) of the second part (12) is at least twice the height of the pallet. Staples (10) fasten the first part to the pallet. A fourth wall (6) is secured to a free edge of the third wall (5) and to a free edge of the first or second wall to which the third wall is not joined, the fourth wall having a length equal to the length of the third wall. A fifth wall extends diagonally between two corners of the spacer. The assembly is folded from a planar sheet (9), and there is a joint between adjacent edges of said third and fourth walls.

11 Claims, 5 Drawing Sheets

PALLET/SPACER ASSEMBLY

The present invention relates to a pallet/spacer assembly comprising an essentially rectangular pallet and four spacers, one of which is fitted at each corner of the pallet in all cases, each spacer comprising an angular section, the angle being essentially a right-angle.

A pallet/spacer assembly of this type is disclosed in French Patent 1,311,981. Said assembly comprises rectangular feet which are fitted under a pallet. Fixing is effected in that special slots are made in the pallet, through which slots protrusions on the spacers are inserted, which protrusions are then folded over. It is clear that for the use of such spacers special pallets are needed. Moreover, this method of fixing is relatively complicated because protruding parts of the spacers have to be inserted very accurately through corresponding slots in the pallet. Removal of the spacers is also a problem. Spacers of this type are used where pallets are stacked on top of one another and the pallets are carrying a load which is of relatively low height and is vulnerable or of uneven height, so that the load can not be utilised for carrying the pallets on top of one another.

The aim of the present invention is to provide a pallet/spacer assembly wherein the spacers are of such construction that said spacers can be used in combination with conventional pallets without it being necessary to take special measures.

This aim is achieved with a pallet/spacer assembly as described above in that each spacer is provided, over a first part of the length of the angular section, with two walls, i.e. the first and second walls, which are at said right angle and wherein, over a second part of the length of the angular section, said section is provided with at least one further, third, wall which joins the free edges of the two parts at right angles, in order to form a tube in this region, the length of the first part corresponding to at least half the height of the pallet.

The invention is based on the insight of allowing the spacer to consist of two parts. A first part, which has a length corresponding to at least half the height of the pallet, comprises an angular section and is intended to be fixed to the pallet in the corner thereof. This type of fixing can be realised using any of the methods disclosed in the prior art, such as gluing. Simple nailing or stapling of such parts is preferred. The second part of the spacer comprises, on one side, an extension of the first part, that is to say the angular section extends both over the height of the pallet and over the freely protruding part of the spacer above or below the pallet. At least one further wall, which rests on the bearing surface of the pallet, adjoins said extension.

It is pointed out that British Patent 1,521,077 discloses a corner support for boxes. In this publication there is no mention of fixing to pallets. A corner support of this type comprises an angular section intended to be placed against the corner of the box concerned. Below said angular section there is a part which is horizontal in the use position and from which a foot extends. A construction of this type requires a relatively large amount of material and, with respect to variation in the spacing between successive pallets, is not very flexible in use because the height of the foot is more or less fixed.

According to an advantageous embodiment the length of the first part is at most equal to the height of the pallet. That is to say the first part is fixed exclusively to the top side of the pallet.

According to a further advantageous embodiment of the invention, the length of the first part is greater than the height of the pallet and the protruding part is folded over against the pallet. That is to say the pallet is enclosed between, on one side, the second part and, on the other side, the folded-over part. Said folded-over part can, of course, be fixed by stapling or the like.

According to an advantageous embodiment of the invention, that part of the spacer which rests on the bearing surface of the pallet and serves to transfer the load, comprises two wall sections. Said two wall sections are joined to the free ends of the angular section so as to form a rectangle. With this construction a further wall can be fitted in such a rectangle as a diagonal, which provides further support. A diagonal of this type can be of single or double construction, that is to say comprise a single wall section which extends from one of the abovementioned wall sections or comprise a double wall section, each part of which extends from one of the wall sections.

The spacer described above is preferably produced from a plane sheet of, for example, corrugated cardboard material. After cutting to shape, a plane sheet of this type can be transported efficiently and, when necessary, folded to form the spacer according to the invention and fixed to the corner of the pallet as described above. Many methods of folding the plane sheet are conceivable. In an embodiment which has a total of four walls, that is to say the angular section and two walls which rest on the bearing surface of the pallet, the join between the walls is preferably made at the free ends of the two further walls, that is to say the walls which each extend from an end of the angular section. If a fifth, diagonal wall is present, the join can still be made at this location. That is to say, the fifth wall is an extension of one of the further walls.

According to a further advantageous embodiment of the invention the second part is extended by a third part and said third part has the same shape as the first part. That is to say that a centring edge is provided which protrudes from the second part for placing a further pallet on the pallet. Preferably, the length of said third part is so chosen that said third part engages on the periphery of the pallet. That is to say the length of the third part and the first part together is less than the height of the pallet.

The pallet/spacer assembly described above can be used particularly advantageously in combination with further protection for the goods to be transported on the pallet.

Thus, it is possible to provide an enclosure which extends round the side walls of the pallet over the height thereof. If appropriate, said enclosure can be completed with a cover. However, it is also possible to use the cover on its own. Furthermore, if the enclosure is close to the walls, it is possible to make a flap-shaped opening in said enclosure.

The invention will be explained in more detail below with the aid of an illustrative embodiment shown in the drawing. In the drawing:

FIG. 1*a* shows one corner of a pallet and a spacer according to the invention before joining together;

FIG. 1*b* shows a top view of the spacer according to the invention;

Figure 1B:
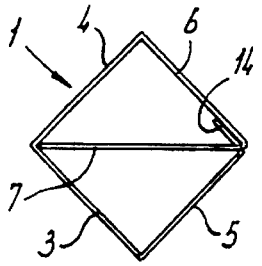
Figure 1A:
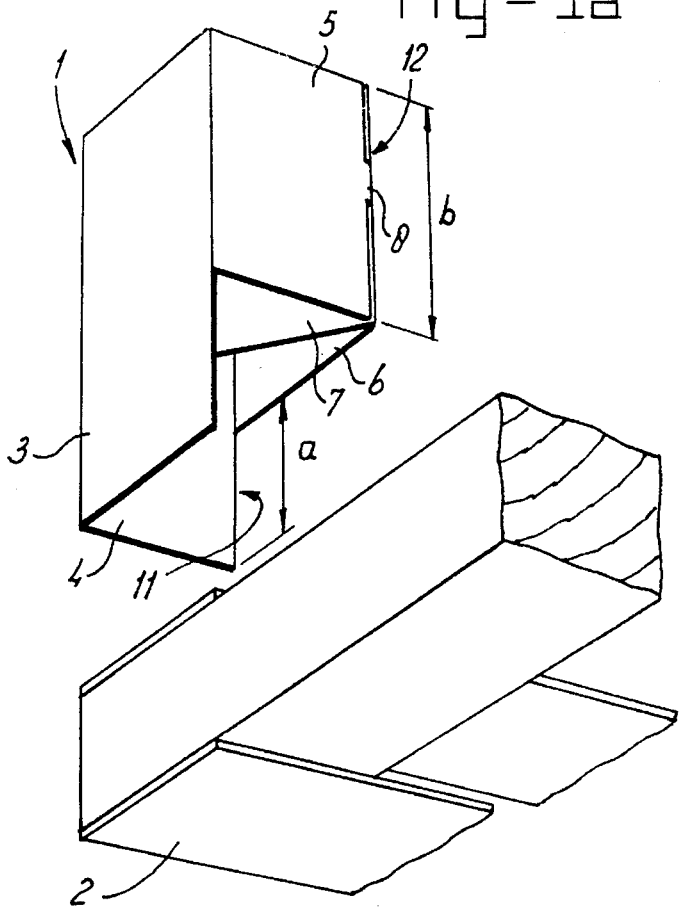

In FIG. 1*a* the spacer according to the invention is indicated in its entirety by 1, whilst the pallet to which said spacer has to be fixed is designated by 2. As can be seen from FIG. 2, the pallet 2 is a conventional pallet. Spacer 1 according to FIG. 1 comprises a first wall 3 and a second wall 4 which together delimit an angular section. Said angular section extends over the entire length of the spacer. In addition, a third wall 5 and a fourth wall 6 are present, which walls together with wall sections 3 and 4 form a square. A diagonal or fifth wall 7 extends between the ends of the walls 5 and 6 and the ends of the walls 3 and 4. Wall 5 and wall 6 are joined at 8. A join of this type comprises a slot 13 and a lip 14, as can be seen more particularly from FIG. 3. From the functional standpoint, spacer 1 comprises two parts. A first part 11, which has a length a, comprises part of the walls 3 and 4. The length a corresponds to the height of the pallet and, as can be seen from FIG. 2, said first part 11 of the spacer serves for fixing to the pallet 2 by means of, for example, nails or staples 10. The second part of the spacer is indicated by 12 and has a length b, which corresponds to the gap between two adjacent pallets. Said second part 12 is formed by the upper sections of the walls 3 and 4 and also by the walls 5–7. A value of 10 cm may be mentioned as an example of the length a, whereas length b is at least 20 cm. A common value is 60 cm.

Figure 3:
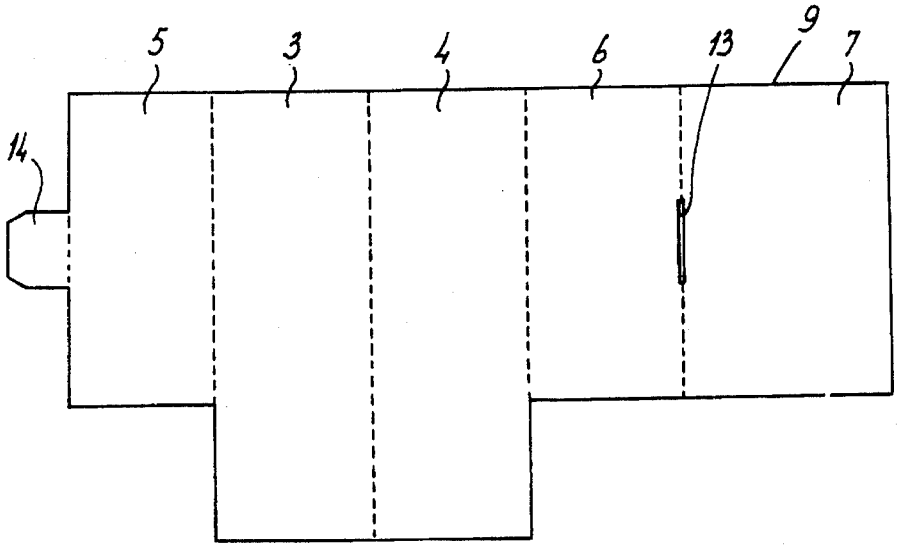
FIG. 3 shows the plane sheet from which the spacer according to FIGS. 1 and 2 can be produced.

It can be seen from FIG. 3 how the spacer 1 according to the invention can be produced from a planar sheet, for example consisting of corrugated cardboard material. As a variant it is possible to make a further wall section in place of lip 14 and to construct said further wall section folded parallel to part 7 as a diagonal. In this case the fixing between wall sections 6 and 5 must, of course, be changed.

Figure 2:
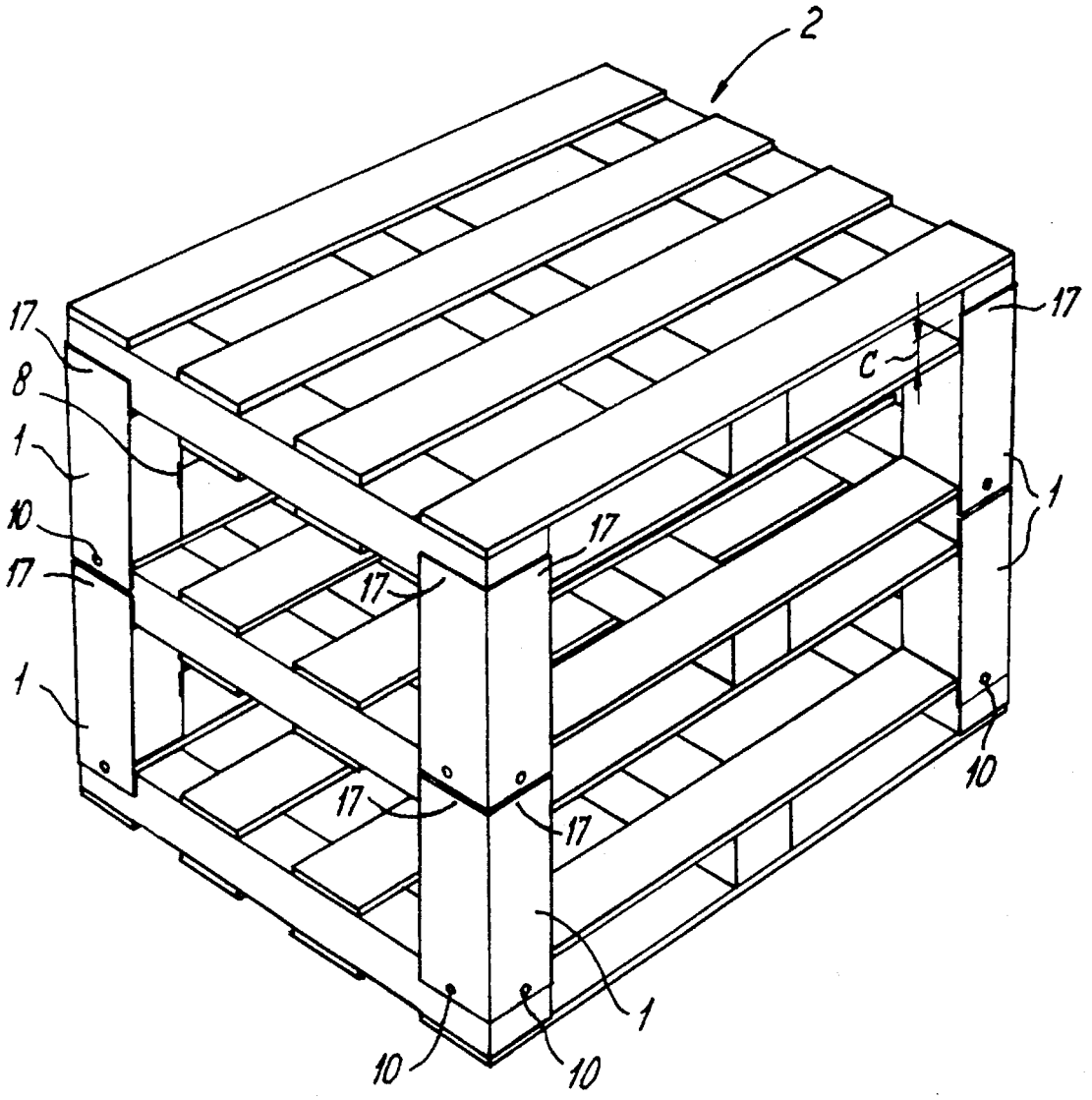
FIG. 2 shows a number of pallets provided with a further spacer according to the invention in a stack.

FIG. 2 shows a number of stacked pallet/spacer assemblies, the spacer assemblies being provided with a third part 17. Said third part 17 comprises extensions of the first wall 3 and the second wall 4, whilst third and further walls are not extended. As a result, a protruding collar section is formed, in which a subsequent pallet can be centred. To make it possible to stack a number of pallets provided with the spacers according to the invention, the first part is shortened correspondingly, that is to say the sum of the length of the first part and the third part is less than the height of the pallet.

Figure 4:
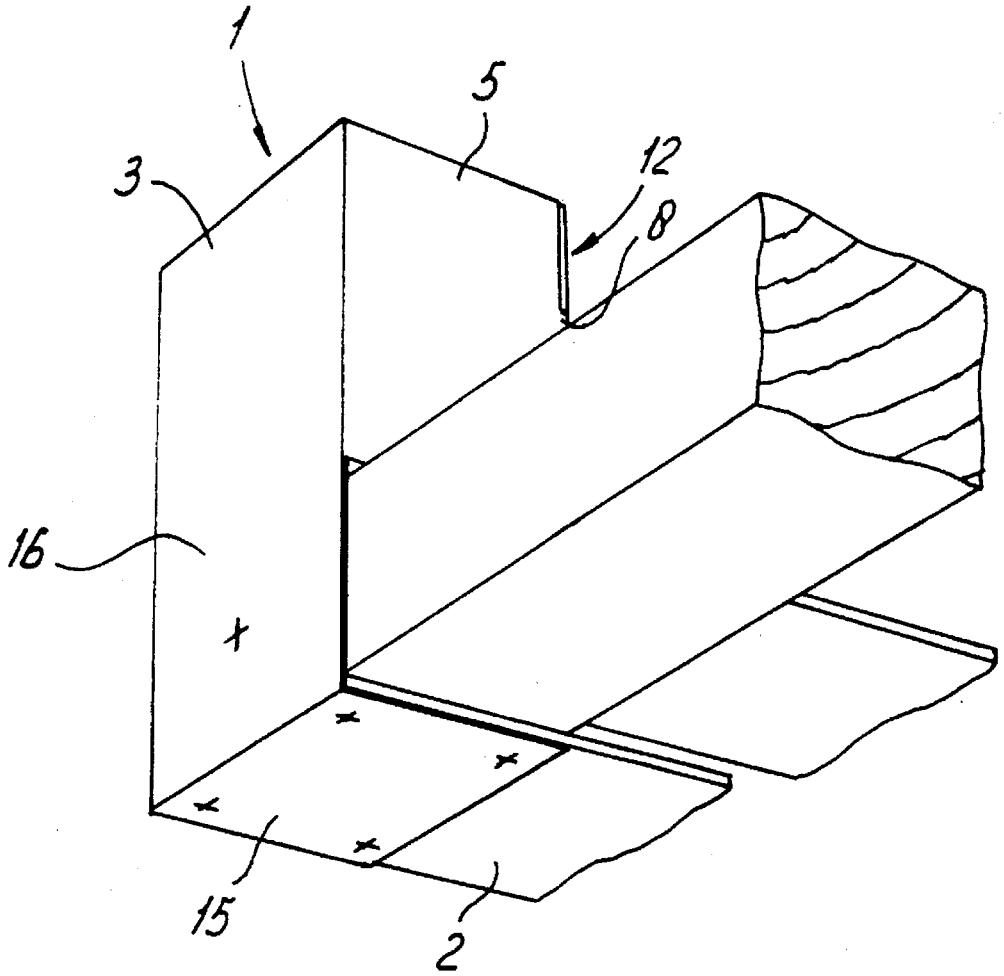
FIG. 4 shows a bottom view of a further embodiment of the spacer according to the invention.

FIG. 4 shows a bottom view of a further embodiment of the pallet/spacer assembly according to the invention. The parts which are the same as those in the figures already described are given the same reference numerals.

It can be seen that the first part, indicated here by 16, differs from the first part 11 according to earlier embodiments because it has a length greater than the height of the pallet. The protruding section, indicated by 15, of the first part is folded over and fixed to the bottom of pallet 2. More stable fixing to the pallet can be obtained in this way.

Figure 5:
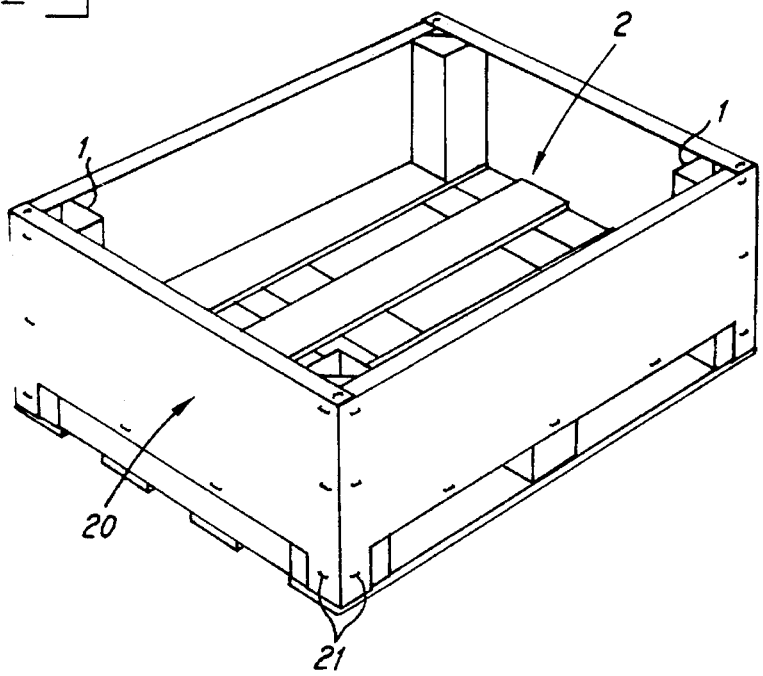
FIG. 5 shows a perspective view of the spacer/pallet in combination with a first enclosure.
Figure 6:
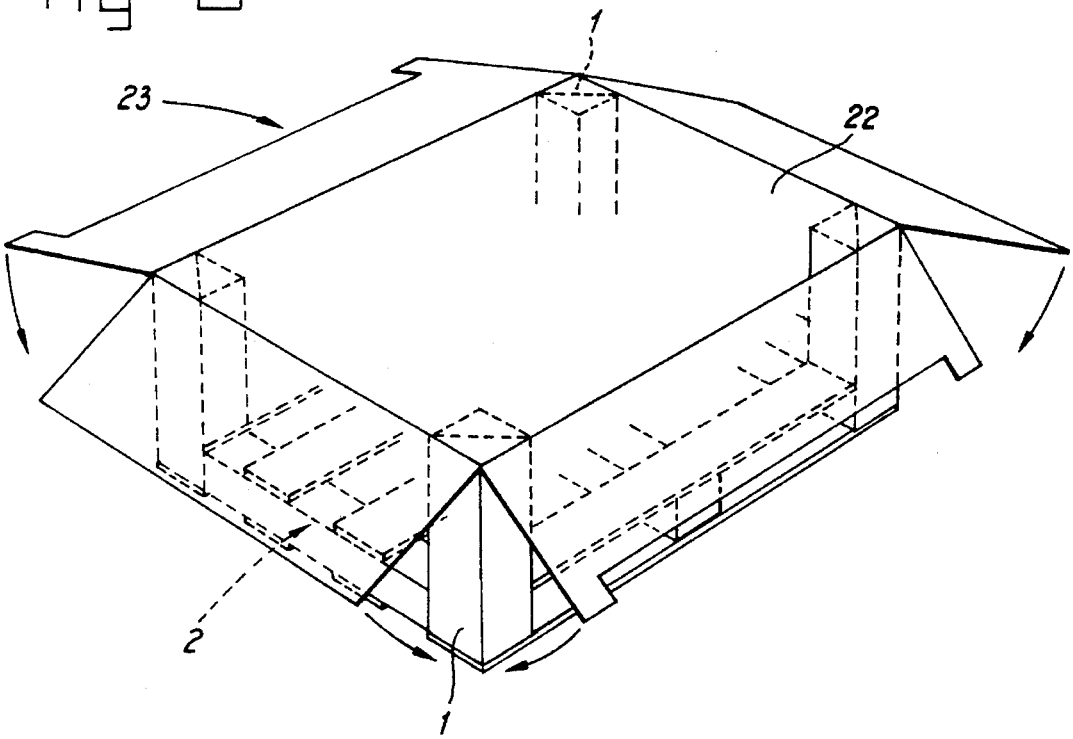
FIG. 6 shows a combination with a second enclosure.

FIG. 5 shows a pallet/spacer combination according to the invention and enclosure. Said enclosure is indicated by 20 and can be a plane sheet made of cardboard. By this means the products are held and protected at the sides, whilst it is possible to remove said products from the top. Said enclosure 20 is fixed with the aid of staples 21. If it is also desired to protect the products at the top, the plane sheet is, according to the embodiment according to FIG. 6, constructed in such a way that a cover is provided. The enclosure is indicated by 23 in this figure. Said enclosure can also be fixed with staples. It is also possible to use film wrap for fixing.

Figure 7:
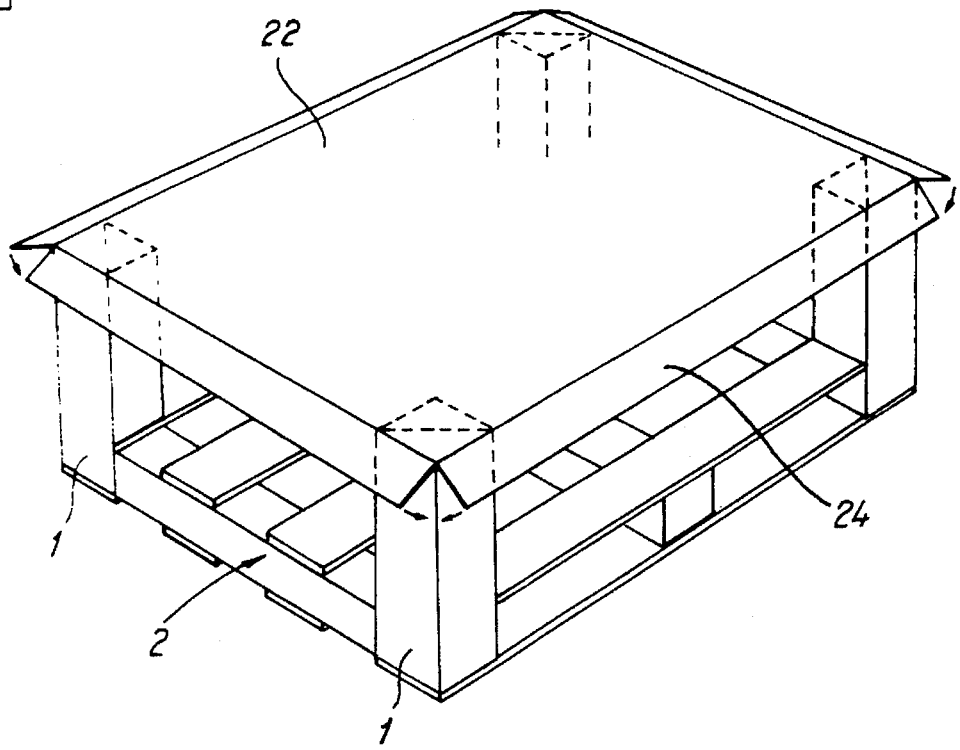
FIG. 7 shows a combination with a cover.

A construction in which only a cover is present is shown in FIG. 7. Said cover is indicated by 22. Because the cover is provided with edges 24 which can be folded over downwards, this embodiment can also be used with film wrap.

Figure 8:
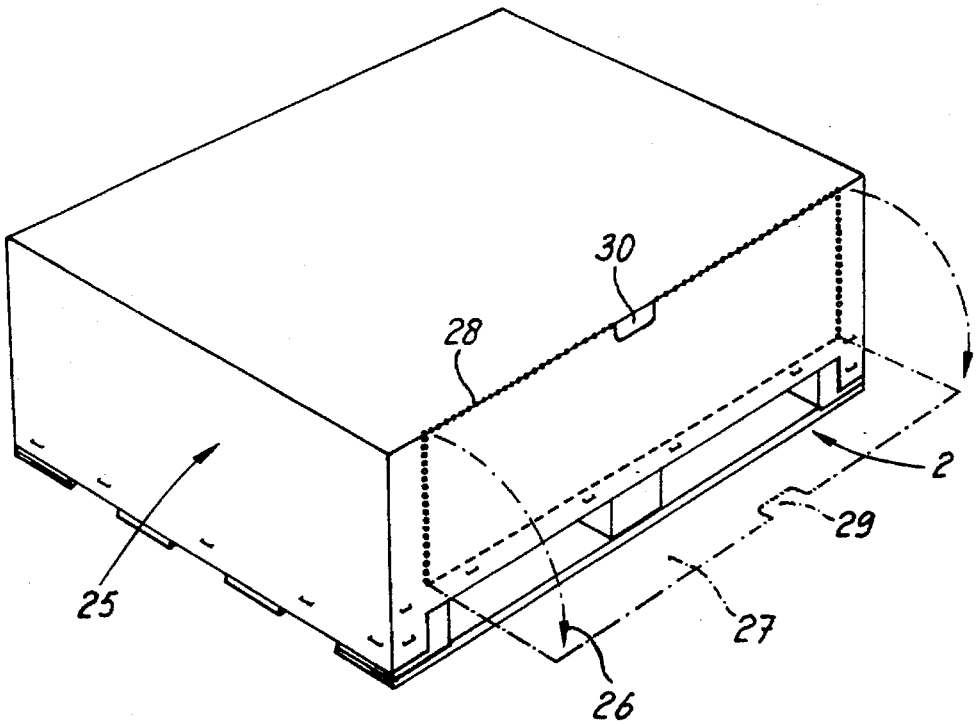
FIG. 8 shows a combination with a third embodiment of an enclosure.

Finally, FIG. 8 shows an enclosure 25 which is provided with a flap 27 which can be moved downwards in the direction of arrow 26. Said flap 27 can be freed from plane sheet 25 by breaking along the perforation line 28. With this construction the perforation is made in such a way that a recess 29 is formed in flap 27 and a lip 30 remains behind in the plane sheet. Said recess and lip can interact to make the construction reclosable. Enclosure 25 is fixed to the pallet with the aid of staples 21.

Although the embodiment of the plane sheet and enclosure shown above are preferred embodiments, it must be understood that the spacer shown in the figures can also be obtained in other ways.

Although the spacer in combination with the pallet has been described above with reference to a preferred embodiment, it must be understood that numerous modifications can be made thereto. The only essential feature is that a further wall section adjoins the angular section and rests on the bearing surface of the pallet.

I claim:

1. Pallets/spacer assembly, comprising a substantially rectangular pallet (2) having a height and four spacers (1) each having a length, one said spacer being fitted at each corner of the pallet, each spacer comprising two walls comprising a first wall (3) and a second wall (4) secured together at substantially right angles, each spacer comprising a first part (11) having a length (a) and a second part (12) having a length (b), only said second part having a third wall (5) secured to a free edge of one of said first and second walls at a right angle, said length (a) of said first part (11) being at least half said height of the pallet, said length (b) of said second part (12) being at least twice said height of the pallet, and means (10) fastening the first part to the pallet.

2. Pallet/spacer assembly according to claim 1, wherein said length (a) of said first part (11) is at most equal to said height of the pallet.

3. Pallet/spacer assembly according to claim 1, wherein said length (a) of the first part is greater than said height of the pallet whereby a part (15) protrudes beyond the pallet, said part (15) being folded over onto the pallet.

4. Pallet/spacer assembly according to claim 1, further comprising a fourth wall (6) secured to a free edge of said third wall (5) and to a free edge of said first or second wall to which said third wall is not joined, said fourth wall having a length equal to a length of said third wall.

5. Pallet/spacer assembly according to claim 4, further comprising a fifth wall extending diagonally between two corners of the spacer.

6. Pallet/spacer assembly according to claim 5, wherein said fifth wall is an extension of one of said third and fourth walls.

7. Pallet/spacer assembly according to claim 1, folded from a planar sheet (9).

8. Pallet/spacer assembly according to claim 7, there being a joint between adjacent edges of said third and fourth walls.

9. Pallet/spacer assembly according to claim 1, wherein said fastening means comprise staples (10).

10. Pallet/spacer assembly according to claim 1, which is bisymmetric about a plane disposed midway of said length of said spacer and perpendicular to said length of said spacer.

11. Pallet/spacer assembly according to claim 1, further comprising an enclosure bridging said four spacers and parallel to said pallet.

* * * * *